US006205942B1

(12) United States Patent
Tsumiyama

(10) Patent No.: US 6,205,942 B1
(45) Date of Patent: Mar. 27, 2001

(54) BULKHEAD STRUCTURE FOR PERSONAL WATERCRAFT

(75) Inventor: Yoshinori Tsumiyama, Miki (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/304,532

(22) Filed: May 4, 1999

(30) Foreign Application Priority Data

Jul. 6, 1998 (JP) ..... 10-190700

(51) Int. Cl.[7] ..... B63B 38/00

(52) U.S. Cl. ..... 114/55.5; 114/55.51; 114/55.57; 114/357

(58) Field of Search ..... 114/55.5–55.58, 114/357

(56) References Cited

U.S. PATENT DOCUMENTS 3,136,288 * 6/1964 Hardy .
5,586,922 * 12/1996 Kobayashi et al. ..... 440/88

FOREIGN PATENT DOCUMENTS

605816 * 6/1960 (IT) ..... 114/357
2-169385 6/1990 (JP) .
3-25396 3/1991 (JP) .
6-199274 * 6/1994 (JP) ..... 114/357
Y2-7-45421 10/1995 (JP) .
8-67296 3/1996 (JP) .

* cited by examiner

*Primary Examiner*—Sherman Basinger
(74) *Attorney, Agent, or Firm*—Oliff & Berridge, PLC

(57) ABSTRACT

A bulkhead structure for a personal watercraft reduces the weight of the personal watercraft while maintaining the rigidity of an outer shell of a body by utilizing the inside space of the body. Alternatively, the structure can further enhance the rigidity of the outer shell of the body without increasing the weight. The hull and a deck are joined to form the outer shell of the body of the personal watercraft. A plate-shaped member spans substantially horizontally in a direction of the width of the body of the personal watercraft and has right and left sides fixed in the vicinity of a junction portion of the hull and the deck.

22 Claims, 7 Drawing Sheets

BULKHEAD STRUCTURE FOR PERSONAL WATERCRAFT

BACKGROUND OF THE INVENTION

1. Field of Invention

The invention relates to a personal watercraft (also called a PWC) that planes along the surface of the water and, more particularly, to a bulkhead structure for the personal watercraft.

2. Description of Related Art

Personal watercraft have been gaining popularity in recent years for sports and recreational purposes. Generally, the personal watercraft is constructed to move forward by increasing the pressure of water drawn through a water intake, provided on a bottom of the body of the watercraft, by a propulsion pump and ejecting the water rearward from the body.

In order to enhance the motion performance of the personal watercraft, it is necessary to reduce the weight thereof. Moreover, wave cutting ability should be improved to enhance comfort for the operator and any passengers on the personal watercraft and to reduce fuel consumption. In order to improve the wave cutting ability of the personal watercraft, it is desirable that the rigidity of an outer shell of the body is high.

When the personal watercraft travels over waves, the bottom of the body receives a water pressure from the waves. The water pressure is transmitted to a handlebar. Consequently, an operator can feel the magnitude of the water pressure by means of the handlebar. The water pressure that the operator feels depends on the rigidity of the outer shell of the body. In a case where the rigidity of the outer shell of the body is high, the outer shell of the body is less deformed when the bottom of the body receives the water pressure from the waves. Consequently, the bottom of the body easily forces the water pressure away to both sides. More specifically, the water cutting ability can be improved so that any riders are comfortable without greatly feeling the water pressure received by the bottom of the body.

The outer shell of the body of the personal watercraft comprises a member provided on a bottom side which is in contact with the water and is referred to as a hull, and a member which covers an upper side of the hull and is referred to as a deck. If thicknesses of these members are reduced, the weight of the personal watercraft can be reduced so that the motion performance thereof can also be enhanced. However, the reduction in the thicknesses of these members causes the rigidity of the outer shell of the body to deteriorate. As a result, the wave cutting ability is degraded.

Accordingly, the hull and the deck require certain minimal thicknesses. For this reason, a reduction in the weight of the personal watercraft is limited.

In most personal watercraft, the inside spaces of the bodies, particularly, the inside spaces of the bow portion are rarely utilized effectively. For example, a storage area or compartment is formed in a part of the space or a buoyancy member is provided therein. However, most of the space is not used but is left as it is. Japanese Utility Model Publication No. Hei 7-45421 discloses the related art.

SUMMARY OF THE INVENTION

In consideration of above-mentioned circumstances, it is an object of the invention to provide a bulkhead structure for a personal watercraft capable of reducing the weight of the personal watercraft while maintaining the rigidity of an outer shell of a body by using an inside space of the body, and of further enhancing the rigidity of the outer shell of the body without increasing the weight.

The invention provides a bulkhead structure for a personal watercraft in which a hull and a deck are joined to form an outer shell of a body. A reinforcing member spans the body substantially horizontally in a direction of a width of the personal watercraft, the reinforcing member having right and left sides fixed in the vicinity of a junction portion of the hull and the deck.

According to the bulkhead structure for a personal watercraft, if the hull or the deck expands or contracts in the direction of a width of the personal watercraft, tensile stress or compressive stress is applied to the reinforcing member but the hull and the deck can be prevented from being deformed by the resisting or counter force of the reinforcing member. Thus, the hull and the deck are strongly constructed, and the rigidity of the outer shell of the bottom can be enhanced without changing the thickness of the hull and the thickness of the deck. Alternatively, the thickness of the hull and the thickness of the deck can be reduced without deteriorating the rigidity of the outer shell of the body.

Each of the right and left ends of the reinforcing member may be interposed between a flange portion formed on a periphery of the hull and a flange portion formed on a periphery of the deck. Usually, the flange portion of the hull and that of the deck are joined by bonding. If the reinforcing member is inserted between the flange portions of the hull and the deck during the bonding step, the personal watercraft can be manufactured with minimal effort.

A recess may be provided in a part of the reinforcing shaped member. With such a structure, the recess functions as storage for accommodating items, and also acts as a rib to enhance the rigidity of a bulkhead itself.

A support portion may be provided between the reinforcing member and the deck or the hull to prevent bending of the reinforcing member. When the hull or the deck contracts in a direction of a width of the personal watercraft, the reinforcing member bends. With the above-mentioned structure, however, the support portion can prevent the reinforcing member from bending. Accordingly, the hull and the deck become stronger in structure so that the rigidity of the outer shell of the body is enhanced.

This object as well as other objects, features and advantages of the invention will become more apparent to those skilled in the art from the following description with reference to the accompanying drawings.

DETAILED DESCRIPTION OF PREFERRED EMBODIMENTS

A bulkhead structure for a personal watercraft according to an embodiment of the invention will be described with reference to the drawings.

Figure 1:
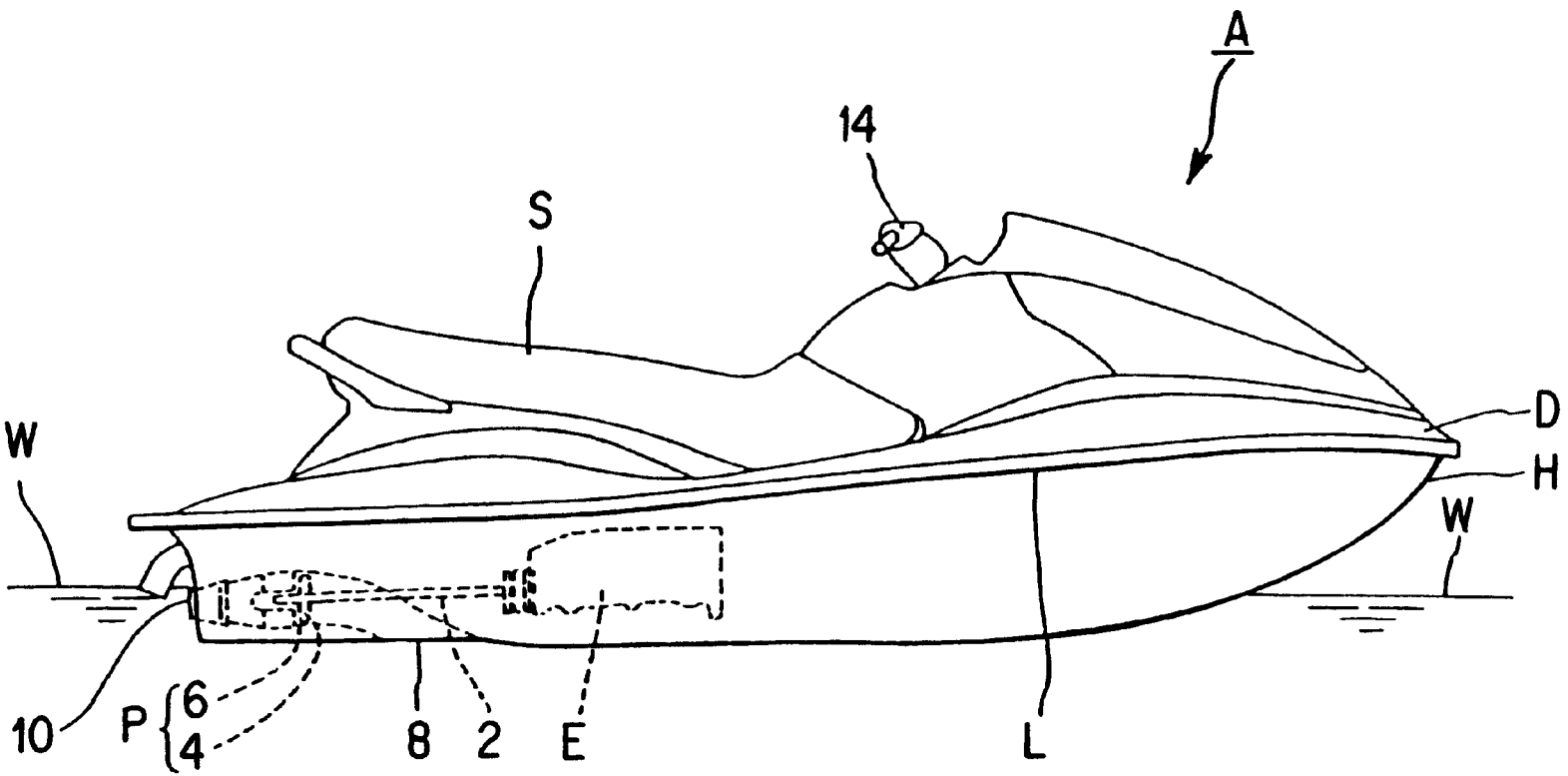
FIG. 1 is a side view showing a personal watercraft employing a bulkhead structure according to an embodiment of the invention.
Figure 2:
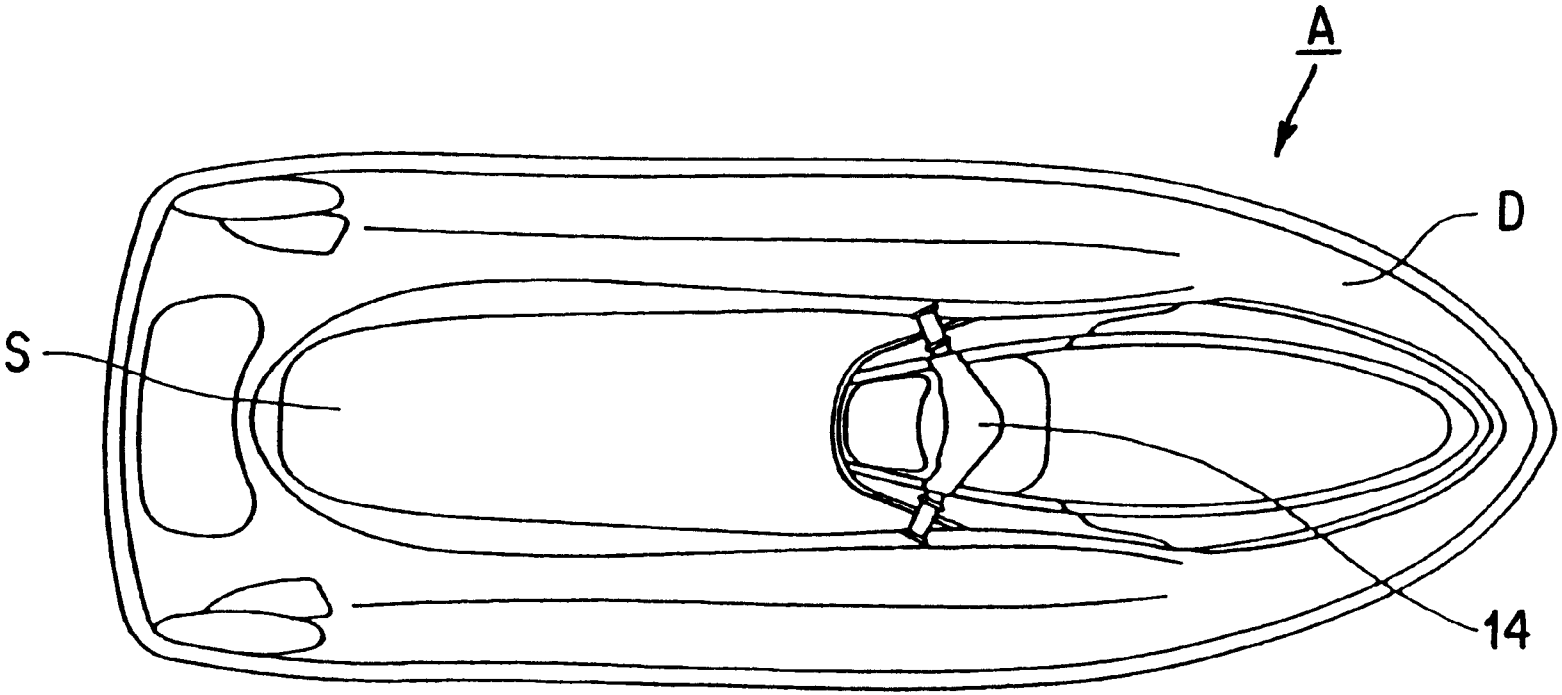
FIG. 2 is a plan view showing the personal watercraft in FIG. 1.

FIG. 1 is a side view showing a personal watercraft A employing the bulkhead structure according to one embodiment of the invention, and FIG. 2 is a plan view of the same. In FIGS. 1 and 2, the personal watercraft A is shown floating on the water, and W indicates the surface of the water. An outer shell of a body of the personal watercraft A includes a hull H and a deck D covering an upper side of the hull H. The personal watercraft A is equipped with an engine E as a power source, and the rotation of the engine E is transmitted to an impeller 4 via a drive shaft (rotation shaft) 2. The impeller 4, together with a casing 6 provided around the outer circumference thereof, constitutes a propulsion pump P. The personal watercraft A is constructed in such a manner that the water drawn through a water intake 8 provided on the bottom of the hull is pressurized by the propulsion pump P and is ejected rearward through a jet nozzle at the rear, thereby producing propulsive force. The jet nozzle is covered by a steering nozzle 10 located further rearward.

The mounting position of the engine varies depending on the type of the personal watercraft. In the personal watercraft A according to this embodiment, the engine E is mounted beneath a seat S. In other words, the seat S is located above an engine room where the engine E is accommodated. Handlebars 14 for steering are mounted in front of the seat S. When the handlebars 14 are steered to the right or left, the steering nozzle 10 swings to the right or left so that the personal watercraft A can be steered in a desired direction. A reverse deflector (not shown) which is turnable downward about a horizontal support shaft is provided above the steering nozzle 10 and further rearward. By turning the deflector to a position rearward of the steering nozzle 10 and thereby causing the water expelled rearward from the steering nozzle 10 to turn toward the front, the personal watercraft A can be moved in a reverse direction.

The hull H and the deck D are made of FRP (fiber reinforced plastics). Flange portions are formed on the peripheries of the hull H and the deck D, respectively. The flange portions are joined to integrate the hull H with the deck D. Thus, the outer shell of the body is formed. The flange portions are joined with an adhesive material. The junction portion circularly appears on a side of the body of the personal watercraft A. A line L is also referred to as a bonding line. A reinforcing member, which is preferably a plate or plate-shaped member, to be described later, is provided almost horizontally over each of the bow and stern portions in an inside space of the body of the personal watercraft A. The inside space of the body is partitioned into upper and lower parts by the reinforcing members. In other words, the reinforcing members act as a bulkhead.

Figure 3:
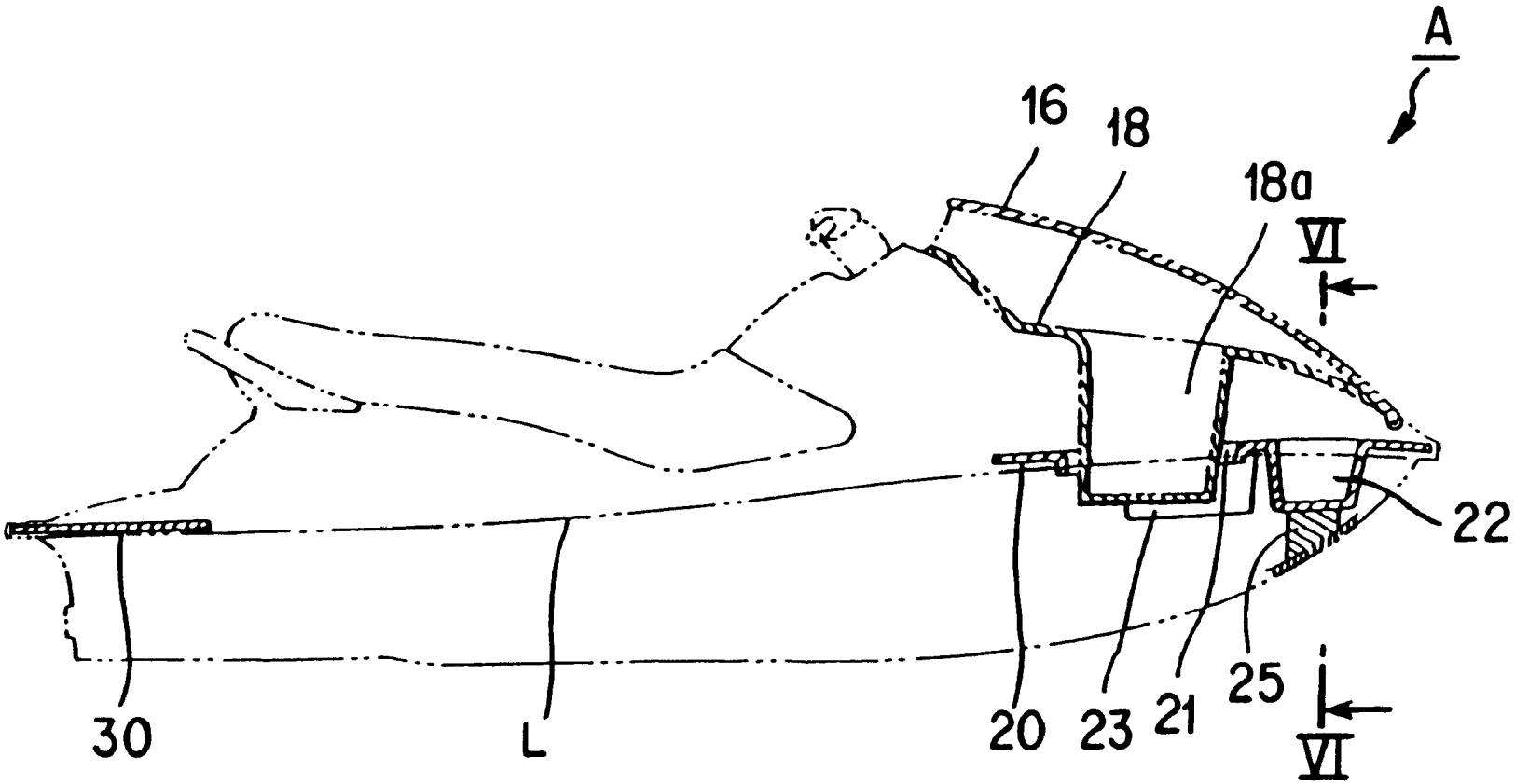
FIG. 3 is a longitudinal sectional view showing an arrangement of plate-shaped members of bow and stern portions in a body, which is taken along center lines of the plate-shaped members illustrated together with contour lines of the personal watercraft as viewed from one side thereof.
Figure 4:
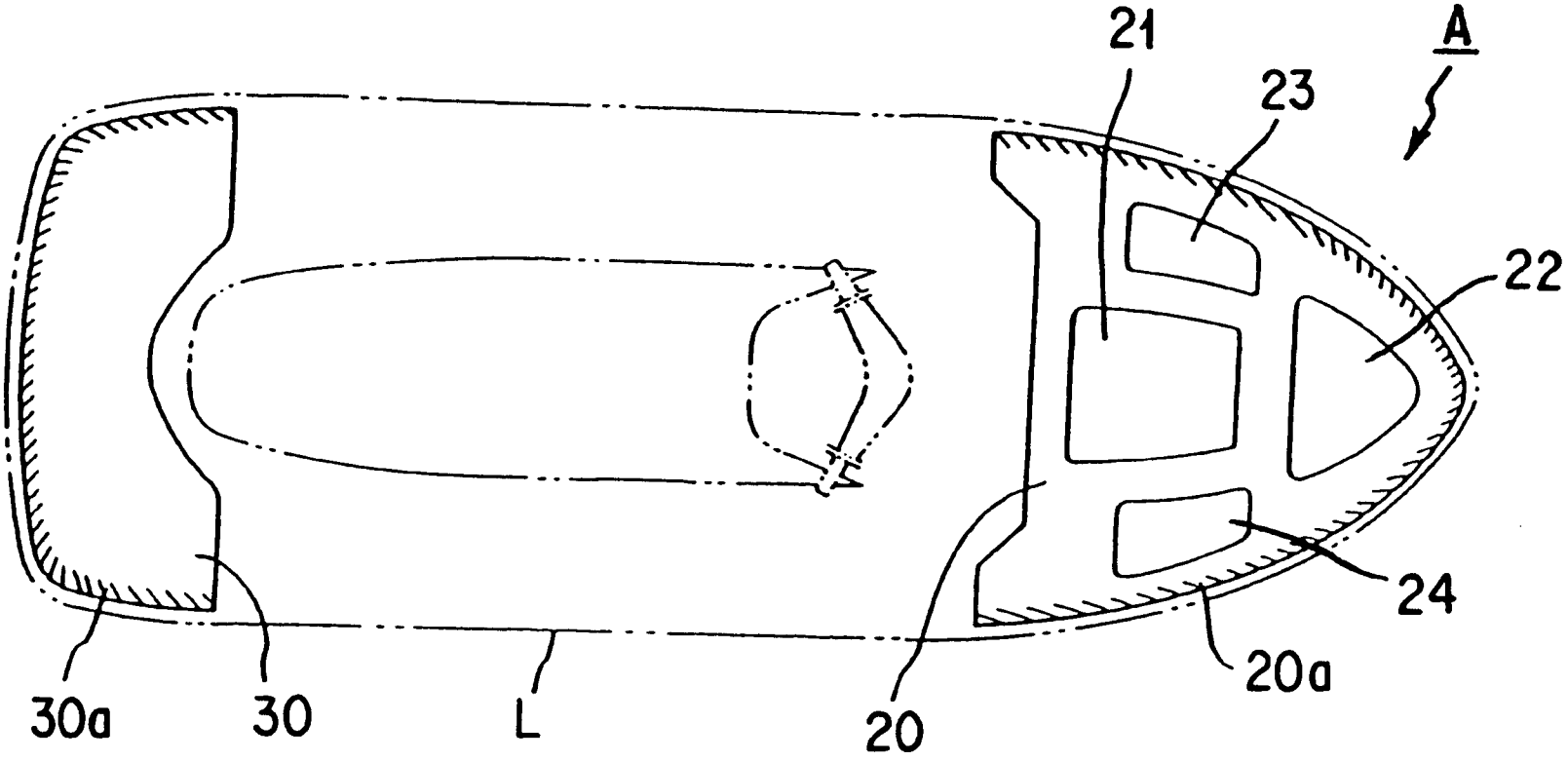
FIG. 4 is a plan view showing the arrangement of the plate-shaped members of the bow and stern portions in the body, the plate-shaped members being illustrated together with a bonding line of the personal watercraft.
Figure 5:
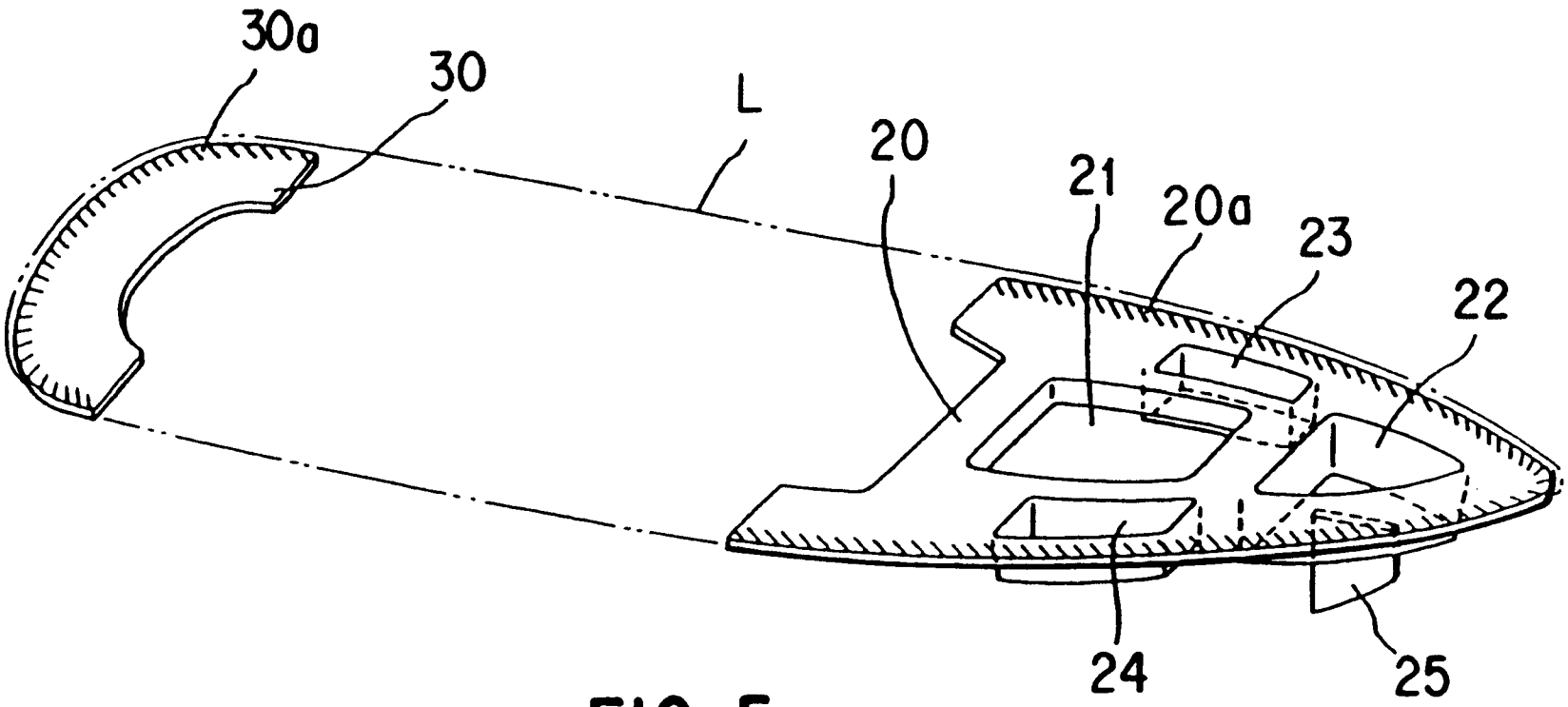
FIG. 5 is a perspective view showing the plate-shaped member together with the bonding line.

FIGS. 3 to 5 are views showing an arrangement of the reinforcing members, which are preferably a plate-shaped member 20 in the bow, or forward, portion and a plate-shaped member 30 of the stern portion in the body. FIG. 3 is a longitudinal sectional view taken along center lines of the plate-shaped members 20, 30 together with contour lines (double dot, dash lines) of the personal watercraft A as viewed from one side thereof. FIG. 4 is a plan view showing the plate-shaped members 20, 30 together with the bonding line L (double dot, dash lines) of the personal watercraft A. FIG. 5 is a perspective view showing the plate-shaped members 20, 30 together with the bonding line L.

As shown in FIGS. 3 to 5, the plate-shaped members 20, 30 span the body substantially horizontally in the direction of the width of the personal watercraft A. The plate-shaped member 20 is provided to be positioned in front of the handlebar 14 and lower than the seat S at the bow portion in the body. The plate-shaped member 30 is provided to be positioned rearward from the rear portion of the seat S and lower than the seat S at the stern portion in the body. In the embodiment, the plate-shaped member 30 is provided such that the front portion thereof has a contour substantially complementary to the rear portion of the seat S as shown in the plan view (FIG. 4). However, the plate-shaped member 30 may be provided such that the front portion thereof actually passes beneath the rear portion of the seat S, i.e., the concave portion is not created. As seen from FIG. 5, particularly, the plate-shaped members 20, 30 are formed respectively such that a part of the periphery of each of them has a shape along the bonding line L.

The lower edge (periphery) of the deck D is formed to have a difference in height, in other words, is concave, equal to the thickness of each of plate shaped members 20, 30 at the portions where a plate-shaped member 20, 30 is provided, which is not particularly illustrated in the drawings. The flange portion Fd of the deck D bends upward according to the shape of the lower edge of the deck D at the portion at which each of the plate-shaped members 20, 30 is provided. As a result a recess is formed between the flange portions Fd, Fh to receive the appropriate plate-shaped member 20, 30. Alternatively, the upper edge (periphery) of the hull H may be formed to have difference in height, concave, according to a thickness of each of plate-shaped members 20, 30 at the portions where a plate-shaped member 20, 30 is provided. The flange portion Fh of the hull H bends downward according to the shape of the upper edge of the hull H at the portion at which each of the plate-shaped members 20, 30 is provided. Again, a recess is formed to receive a plate-shaped member 20,30.

Figure 6:
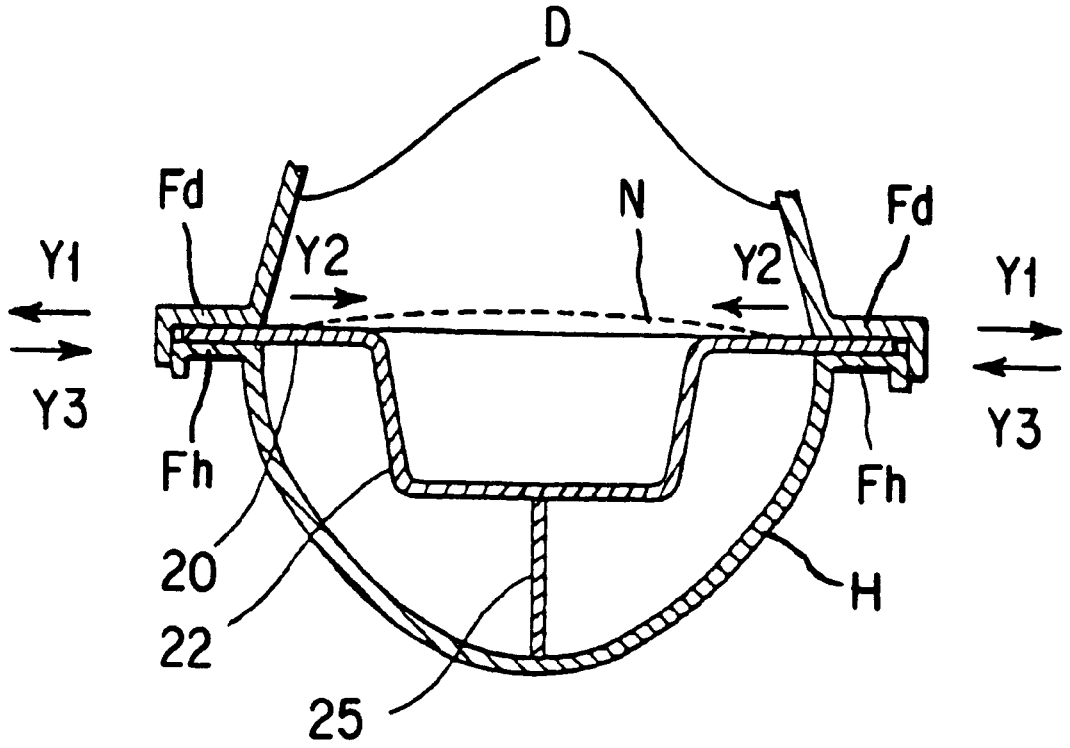
FIG. 6 is a sectional view taken along the line VI—VI in FIG. 3.

As is apparent from FIGS. 5 and 6, a peripheral portion 20*a* of the plate-shaped member 20 and a peripheral portion 30*a* of the plate-shaped member 30 are interposed between the flange portions Fh, Fd of the hull H and the deck D, respectively, and bonded to the flange portions Fh, Fd of the hull H and the deck D. As for the portion without the plate-shaped member 20, 30 of flange Fh, Fd of the hull H and the deck D, respectively, the flange Fh of hull H and the flange Fd of deck D are directly bonded to one another. Although the plate-shaped members 20, 30 are made of FRP in the embodiment, the material from which they are made does not need to be particularly restricted but can include wood, aluminum, and plastics (resins) other than FRP, for example.

At a step of manufacturing and assembling a conventional personal watercraft which is not provided with the plate-shaped member, the hull and the deck are directly bonded by means of the flange portions. When the personal watercraft A according to the embodiment is to be assembled, a simple step of inserting the plate-shaped members 20, 30 between the flange portions is added to the conventional assembling step.

The plate-shaped members 20, 30 are thus fixed to the junction portion of the hull H and the deck D, that is, the junction portion of the flange portions. Right and left (i.e., starboard and port) sides and the front end apex of the peripheral section of the plate-shaped member 20 and right and left sides and a rear side of the peripheral portions of the plate-shaped member 30 are fixed to the junction portion, respectively.

The plate-shaped member 20 has a hole 21 and recesses 22, 23 and 24 formed therein. An inside cover 18 is provided in the bow portion of the space in the body. The inside cover 18 appears when a hatch cover 16 formed on the top of the deck D is opened. A storage area 18*a* is formed in the inside cover 18. The hole 21 of the plate-shaped member 20 allows the storage area 18*a* to pass therethrough, i.e, be received therein. The inside cover 18 can also be opened and closed. When the inside cover 18 is opened, the plate-shaped member 20 appears. The recesses 22, 23 and 24 formed on the plate-shaped member 20 can also be used as storage areas.

FIG. 6 is a sectional view taken along the line VI—VI in FIG. 3. As shown in FIGS. 5 and 6, a support portion 25 is provided between a bottom face of the recess 22 and the hull H, therefore the plate-shaped member 20 can be supported on the hull H in a perpendicular direction.

With reference to FIG. 6, the action of the plate-shaped member 20 will be described below. As described above, the outer shell of the body is formed by the hull H and the deck D. In the case that some external force acts on the outer shell of the body and a flange portion Fh of the hull H and a flange portion Fd of the deck D expand in a direction of an arrow Y1 in FIG. 6, the right and left sides of the plate-shaped member 20 are pulled outwardly so that tensile stress acts on the plate-shaped member 20. The flange portions Fh and Fd contract in a direction of an arrow Y2 on receipt of the resisting force of the plate-shaped member 20. Consequently, the outer shell of the body can be prevented from being deformed. Thus, the rigidity of the outer shell of the body can be enhanced.

In the case that some external force acts on the outer shell of the body and the flange portions Fh and Fd contract in a direction of an arrow Y3 in FIG. 6, the plate-shaped member 20 receives compression from the right and left sides so that compressive stress acts on the plate-shaped member 20. The flange portions Fh and Fd receive the resisting force of the plate-shaped member 20. Consequently, the outer shell of the body can be prevented from being deformed. Furthermore, when the external force acting on the outer shell of the body is increased, an upper face of the plate-shaped member 20 comes to form a deflection curve shown by a dotted line N, for example. However, the support portion 25 operates to keep a constant distance between the bottom face of the recess 22 and the hull H. Therefore, the plate-shaped member 20 cannot bend greatly. As a result, the flange portions Fh and Fd cannot contract in the direction of the arrow Y3 in FIG. 6. Thus, the rigidity of the outer shell of the body is enhanced by the support portion 25.

The recesses 22, 23 and 24 shown in FIGS. 4 and 5 also function as ribs formed on the plate-shaped member 20. Therefore, the rigidity of the plate-shaped member 20 itself is increased. As a result, the rigidity of the outer shell of the body formed by the hull H and the deck D is enhanced.

Thus, the outer shell of the body is highly resistant to deformation due to the reinforcing provided by the plate-shaped member 20. Accordingly, even if the thickness of the hull H and the thickness of the deck D are reduced, it is possible to obtain the necessary rigidity for great wave cutting ability by the personal watercraft. If the thickness of the hull H and the thickness of the deck D are decreased, the weight of the personal watercraft A can be reduced. As a result, fuel consumption can also be reduced.

Although the recess and the support portion are not formed on the plate-shaped member 30 provided in the stern portion, the rigidity of the outer shell of the body at the stern is enhanced in the same manner as with the plate-shaped member 20 in the bow. Although two plate-shaped members 20, 30 have been provided in the embodiment, at least one plate-shaped member may be provided, nevertheless they contribute to an enhancement in the rigidity of the outer shell of the body.

Although the support portion 25 has been attached to the bottom face of the recess 22 of the plate-shaped member 20 in the embodiment, it may be attached to a portion of the plate-shaped member 20 other than the recess.

Also, although the support portion 25 has been provided between the plate-shaped member 20 and the hull H in the embodiment, the same effects can be obtained with a structure in which the support portion 25 is provided between the plate-shaped member 20 and the deck D.

Figure 7:
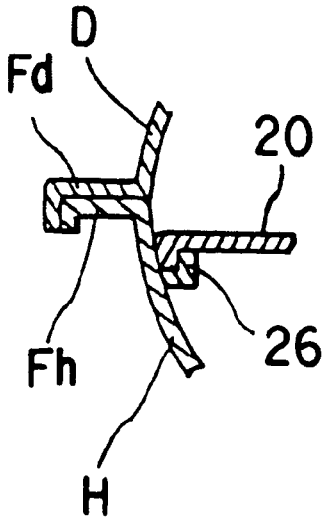
FIG. 7 is a sectional view showing another example of a method for fixing the plate-shaped member in the vicinity of a junction portion.

FIG. 7 is a sectional view showing another example of a method for fixing a plate-shaped member in the vicinity of the junction portion of the hull and the deck of the body. The flange portion Fh of the hull H and the flange portion Fd of the deck D are directly bonded with an adhesive material. The periphery of the plate-shaped member 20 vertically bends downwardly. The periphery is engaged with an engagement portion 26 formed in a slightly lower position than a position of the flange portion Fh on an inside face of the hull H. By such a structure, the periphery of the plate-shaped member 20 may be fixed in the vicinity of the junction portion of the hull H and the deck D. While the plate-shaped member 20 is fixed to the hull H side in FIG. 7, it may be fixed to the deck D side.

Figure 8:
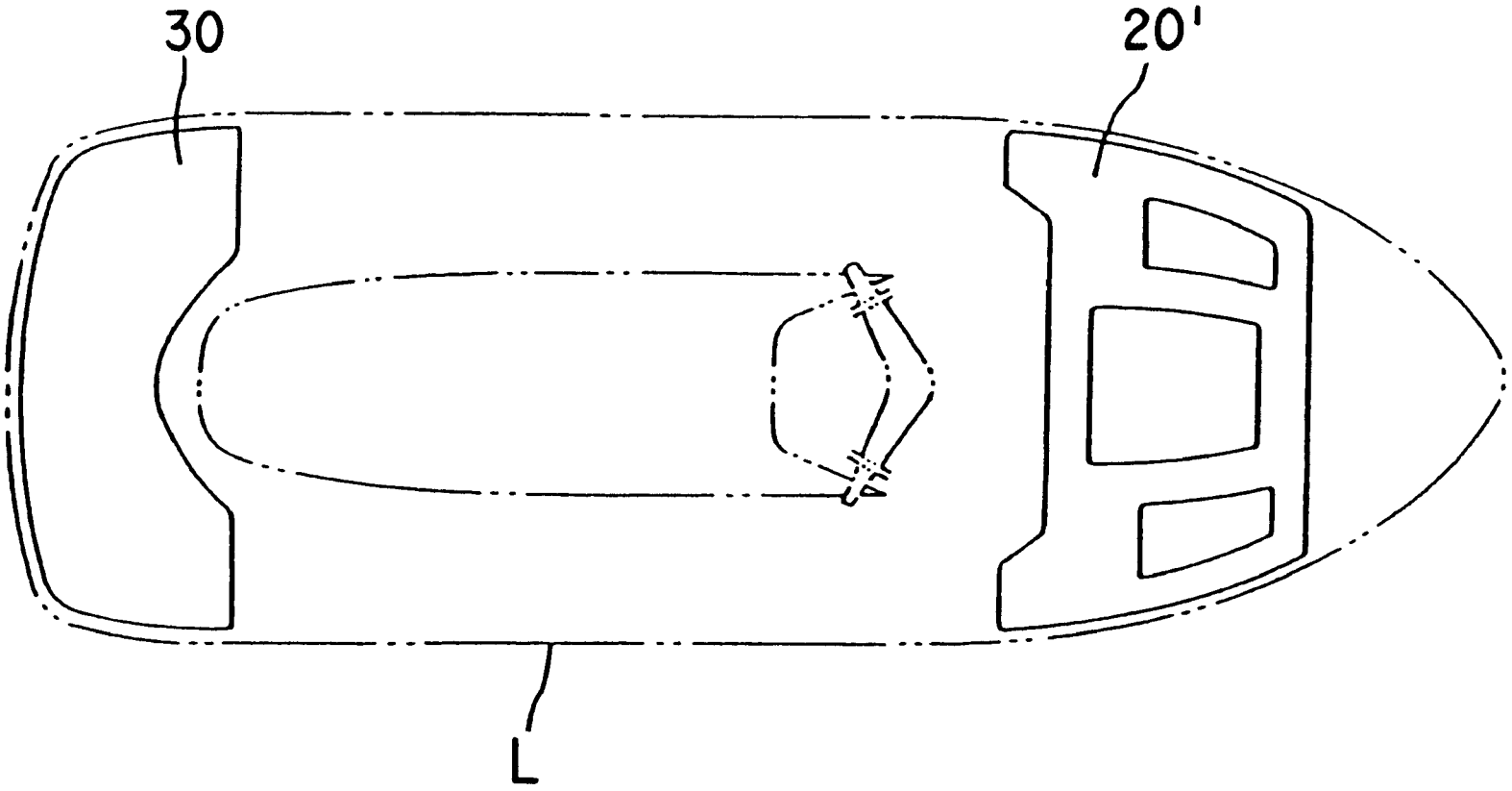
FIG. 8 is a plan view showing the plate-shaped member together with the bonding line.

FIG. 8 is a plan view showing, together with a bonding line L, a plate-shaped member 20' having a different shape from that of the plate-shaped member 20 in FIGS. 3 to 5. The plate-shaped member 20' is formed in such a manner that right and left sides thereof have shapes conforming to the bonding line L, and is interposed between the flange portions of the hull H and the deck D. Although the right and left sides of the plate-shaped member 20' are thus fixed in the vicinity of the junction portion of the hull H and the deck D, a front end is not fixed in the vicinity of the junction portion to differ from the plate-shaped member 20 shown in FIGS. 3 to 5. However, if the plate-shaped member has at least the right and left ends fixed in the vicinity of the junction portion and provided in the direction of the width of the personal watercraft, the rigidity of the outer shell of the body can fully be enhanced.

Numerous modifications and alternative embodiments of the invention will be apparent to those skilled in the art in view of the foregoing description. For example, a preferred embodiment of the invention has been described in relation to a reinforcing member which is a plate or plate-shaped member. Other types of reinforcing members are possible, such as beams, tubes or cylinders to reinforce the personal watercraft by spanning the width of the personal watercraft. Accordingly, this description is to be construed as illustrative only, and is provided for the purpose of teaching those skilled in the art the best mode of carrying out the invention. The details of the structure and/or function may be varied substantially without departing from the spirit of the invention.

What is claimed is:

1. A personal watercraft in which a hull and a deck are joined to form an outer shell of a body, comprising:

a steering handle;

a propulsive water jet pump located rearward of the body to move the watercraft;

a hatch cover located forward of the steering handle;

a reinforcing member having at least a substantial portion spanning the width of the body of the personal watercraft in a single plane, located forward of the steering handle and beneath the hatch cover;

the reinforcing member having right and left sides fixed in a vicinity of a junction portion of the hull and the deck.

2. The personal watercraft according to claim 1, wherein each of the right and left sides of the reinforcing member is interposed between a flange portion formed on a periphery of the hull and a flange portion formed on a periphery of the deck.

3. The personal watercraft according to claim 1, wherein a recess is provided in part of the reinforcing member to accommodate a storage container area.

4. The personal watercraft according to claim 1, wherein a support member is provided between the reinforcing member and one of the deck and the hull to keep a constant distance between the reinforcing member and one of the deck and the hull.

5. The personal watercraft according to claim 1, wherein the reinforcing member is a plate shaped member.

6. A personal watercraft, comprising:

a hull;

a deck mounted to the hull to form a body;

a handle for operating the watercraft; and a plate fixedly mounted to the body proximate a mounting line of the deck to the hull, the plate extending between starboard and port sides to span a width of the body, a substantial portion of which spans the width of the body in a substantially horizontal plane, wherein the plate spans the body from starboard to port in an area only between a bow of the personal watercraft and a portion forward of the handle for operating the personal watercraft.

7. The personal watercraft according to claim 6, wherein a periphery of the plate follows a contour of the body.

8. The personal watercraft according to claim 7, wherein the plate is peripherally sealed between the hull and the deck.

9. The personal watercraft according to claim 7, wherein the plate is peripherally attached to a one of the deck and hull.

10. The personal watercraft according to claim 1, wherein the reinforcing member is a plate and the plate is peripherally sealed between the hull and the deck.

11. The personal watercraft according to claim 1, wherein the reinforcing member is a plate and the plate is peripherally attached to one of the hull and the deck.

12. The personal watercraft of claim 1, wherein reinforcing member is a plate and further comprising an other plate which spans the body from starboard to port in stern portion of the body.

13. The personal watercraft according to claim 12, wherein the other plate follows a contour of the stern of the body.

14. The personal watercraft according to claim 13, wherein the other plate is peripherally sealed between the hull and the deck.

15. The personal watercraft of claim 13, wherein the other plate is peripherally attached to a one of the deck and the hull.

16. The personal watercraft according to claim 12, wherein the body contains a seat and a pump case, and the other plate is provide on a portion of the body rearward of the rear portion of the seat and above the pump case.

17. A personal watercraft, comprising:

a hull;

a deck mounted to the hull to form a body;

a handle for operating the watercraft; and a plate fixedly mounted to the body proximate a mounting line of the deck to the hull, the plate extending between starboard and port sides to span a width of the body, a substantial portion of which spans the width of the body in a substantially horizontal plane, wherein the plate spans the body from starboard to port in an area only between a bow of the personal watercraft and a portion forward of the handle for operating the personal watercraft; and a support plate transverse to the plate and extending from the plate to one of the deck and the hull along a centerline of the body.

18. A personal watercraft, comprising:

a hull;

a deck mounted to the hull to form a body;

a handle for operating the watercraft;

a plate fixedly mounted to the body proximate a mounting line of the deck to the hull, the plate extending between starboard and port sides to span a width of the body, a substantial portion of which spans the width of the body in a substantially horizontal plane, wherein the plate spans the body from starboard to port in an area only between a bow of the personal watercraft and a portion forward of the handle for operating the personal watercraft; and wherein at least one hole that accommodates a storage container to pass therethrough is formed in the plate.

19. A personal watercraft, comprising:

a hull;

a deck mounted to the hull to form a body;

a handle for operating the watercraft:

a plate fixedly mounted to the body proximate a mounting line of the deck to the hull, the plate extending between starboard and port sides to span a width of the body, a substantial portion of which spans the width of the body in a substantially horizontal plane, wherein the plate spans the body from starboard to port in an area only between a bow of the personal watercraft and a portion forward of the handle for operating the personal watercraft; and wherein the plate has a concave portion opening to the deck to form a storage area.

20. The personal watercraft according to claim 1, wherein the reinforcing member is a plate and further comprising a support plate transverse to the plate and extending from the plate to one of the deck and the hull along a centerline of the body.

21. The personal watercraft according to claim 1, wherein the reinforcing member is a plate and at least one hole is formed in the plate.

22. The personal watercraft according to claim 1, wherein the reinforcing member is a plate and the plate has a concave portion opening to the deck to form a storage area.

* * * * *